US007617952B2

(12) United States Patent
Saleh et al.

(10) Patent No.: US 7,617,952 B2
(45) Date of Patent: Nov. 17, 2009

(54) DISPENSER FOR DISINFECTING GEL

(76) Inventors: George A. Saleh, 200 NE. 54th St., Suite 111, Kansas City, MO (US) 64118; Caleob T. King, 244 Haskell Rd., Quenemo, KS (US) 66528

( * ) Notice: Subject to any disclaimer, the term of this patent is extended or adjusted under 35 U.S.C. 154(b) by 553 days.

(21) Appl. No.: 11/343,009

(22) Filed: Jan. 30, 2006

(65) Prior Publication Data

US 2007/0039976 A2 Feb. 22, 2007

(51) Int. Cl.
*B67D 5/64* (2006.01)

(52) U.S. Cl. ..... 222/175; 222/96; 222/103; 222/105; 222/185.1; 222/212; 222/214; 224/235; 224/269; 251/7; 251/9

(58) Field of Classification Search ..... 222/175, 222/224, 95–96, 103, 105, 212–214, 185.1; 251/7, 9; 224/235, 251, 269
See application file for complete search history.

(56) References Cited

U.S. PATENT DOCUMENTS 3,368,722 A * 2/1968 Wallace ..... 222/214
3,450,313 A * 6/1969 Jonas ..... 222/402.13
3,726,436 A * 4/1973 Despain et al. ..... 222/213
4,506,806 A * 3/1985 Lincoln et al. ..... 222/175
4,706,273 A * 11/1987 Spear et al. ..... 455/569.2
4,708,273 A * 11/1987 Grant ..... 224/148.6
4,776,495 A * 10/1988 Vignot ..... 222/207
4,836,416 A * 6/1989 Shalgi et al. ..... 222/48
4,930,667 A * 6/1990 Holzner, Sr. ..... 222/189.09
5,088,624 A * 2/1992 Hackett et al. ..... 222/78
5,215,227 A * 6/1993 Farner ..... 222/175
5,261,570 A * 11/1993 Hippely et al. ..... 222/212
5,323,932 A * 6/1994 Bauman ..... 222/96
5,348,193 A * 9/1994 Bruckner et al. ..... 222/175
5,398,848 A * 3/1995 Padamsee ..... 222/94
5,429,301 A * 7/1995 Franks ..... 239/1
5,476,194 A * 12/1995 Hippely et al. ..... 222/192
5,501,372 A * 3/1996 Daansen ..... 222/207
5,570,817 A * 11/1996 Anderson et al. ..... 222/153.11
5,678,730 A * 10/1997 Fabek et al. ..... 222/78
5,683,012 A * 11/1997 Villaveces ..... 222/82
5,819,986 A * 10/1998 Last et al. ..... 222/95
5,927,548 A * 7/1999 Villaveces ..... 222/82
5,992,698 A * 11/1999 Copeland et al. ..... 222/180
6,036,056 A * 3/2000 Lee et al. ..... 222/63
6,036,058 A * 3/2000 Chou ..... 222/214
6,053,360 A * 4/2000 Rutter ..... 222/1

(Continued)

*Primary Examiner*—Kevin P Shaver
*Assistant Examiner*—Andrew P Bainbridge
(74) *Attorney, Agent, or Firm*—Lathrop & Gage LLP

(57) ABSTRACT

Portable dispensers and methods of use are disclosed herein. A portable dispenser includes an output device and a housing having a receiving area configured to accept a container having an opening and housing a viscous fluid (i.e., a disinfecting gel). The housing also includes a fastener for selective attachment to an article of clothing. The output device is selectively coupled to the container so that the viscous fluid may selectively pass from the container through the container opening and the output device. An output device of another portable dispenser is selectively coupled to the container so that the fluid may selectively pass from the container through the container opening and the output device without first being transferred from the container to the dispenser for storage. Methods for using the portable dispensers are also provided.

17 Claims, 9 Drawing Sheets

U.S. PATENT DOCUMENTS 6,062,434 A * 5/2000 Melk ..... 222/175
6,092,695 A * 7/2000 Loeffler ..... 222/207
6,131,773 A * 10/2000 Wade et al. ..... 222/153.02
6,189,740 B1 * 2/2001 Wade et al. ..... 222/207
6,216,916 B1 * 4/2001 Maddox et al. ..... 222/105
6,220,490 B1 * 4/2001 O'Hara ..... 224/148.2
6,234,357 B1 * 5/2001 Lewis ..... 222/175
6,241,135 B1 * 6/2001 Thatcher ..... 224/148.5
6,276,579 B1 * 8/2001 DeLoach ..... 224/148.3
6,283,334 B1 * 9/2001 Mahaffey et al. ..... 222/175
6,540,110 B2 * 4/2003 Weiser ..... 222/103
6,666,360 B1 * 12/2003 Swank ..... 224/148.2
6,698,716 B2 * 3/2004 Yang ..... 251/288
6,729,506 B2 * 5/2004 Brown et al. ..... 222/325
6,749,090 B2 * 6/2004 Bailey ..... 222/175
6,883,563 B2 * 4/2005 Smith ..... 141/94
6,983,864 B1 * 1/2006 Cagle ..... 222/131
7,100,801 B2 * 9/2006 Brown et al. ..... 222/105
2001/0035430 A1 * 11/2001 Litscher ..... 222/94

* cited by examiner

DISPENSER FOR DISINFECTING GEL

BACKGROUND OF THE INVENTION

This invention relates generally to a dispenser for disinfecting gel. In particular, the present invention relates to a dispenser for disinfecting gel that is attachable to an article of clothing and that may be used with one hand without first transferring the gel from the container in which it is purchased to the dispenser.

To stop the spread of infection and illness, it is desirable that many People—and especially those in the healthcare industry—frequently sanitize their hands. While soap and water is not a convenient option due to the immobile nature of plumbing, disinfecting gel is a sanitary alternative. There are currently disinfecting gels on the market that claim to kill 99.99% of the most common germs that may cause illness in as little as 15 seconds, and many of these additionally include moisturizers that are good for skin.

Nevertheless, these disinfecting gels currently come in capped bottles that are not convenient to use for a variety of reasons. To name a few, these bottles must be carried in a pocket or in a similar manner, these bottles must be manually opened and closed every time they are used, and these bottles are often lost. Simply put, it is often inconvenient or impractical to use these bottles as often as would be desirable.

To overcome these shortcomings, a portable dispenser for a viscous fluid (i.e., a disinfecting gel) is described herein, along with methods of use.

SUMMARY OF THE INVENTION

Portable dispensers and methods of use are disclosed herein. A portable dispenser of one embodiment includes an output device and a housing having a receiving area configured to accept a container having an opening and housing a viscous fluid. The housing also includes a fastener for selective attachment to an article of clothing. The output device is selectively coupled to the container so that the viscous fluid may selectively pass from the container through the container opening and the output device.

In an embodiment, a dispenser for a disinfecting gel is provided, including a housing, a fastener, and an output device. The housing has a receiving area configured to receive a container having an opening and housing the disinfecting gel. The fastener is attached to the housing for selectively attaching the housing to an article of clothing. The output device is selectively coupled to the container so that the disinfecting gel may selectively pass from the container through the container opening and the output device without first being transferred from the container to the dispenser for storage.

In an embodiment, a method for dispensing a disinfecting gel from a container having an opening is provided. The method includes the steps of providing a dispenser that has an output device and a housing, coupling the output device and the container, and selectively releasing an amount of the disinfecting gel from the container through the output device. The dispenser housing defines a receiving area configured for accepting the container, and the dispenser housing has a fastener for selective attachment to an article of clothing.

DESCRIPTION OF THE PREFERRED EMBODIMENT

Figure 1:
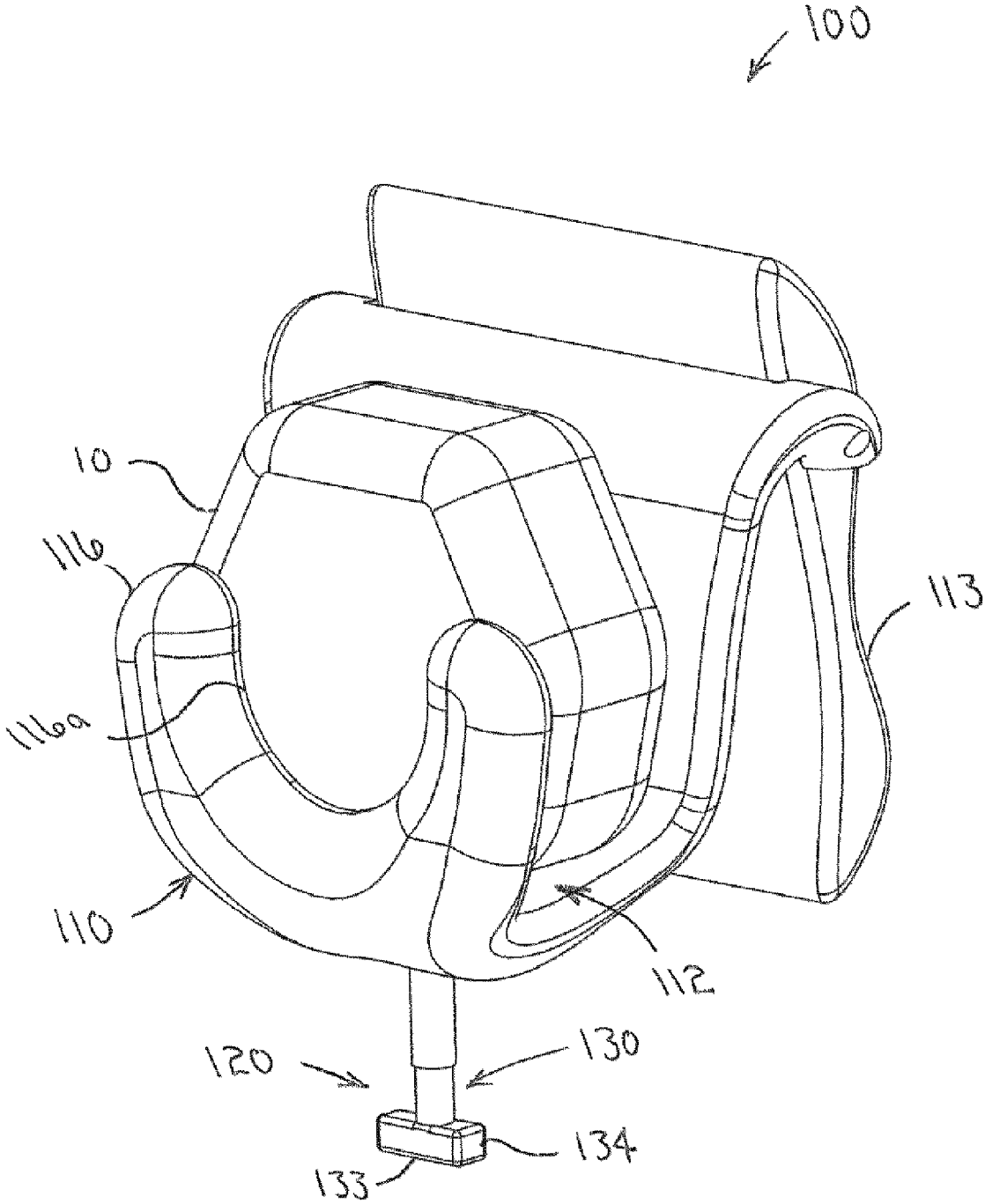
FIG. 1 is a perspective view showing a portable dispenser for a viscous fluid coupled to a container according to an embodiment.
Figure 3:
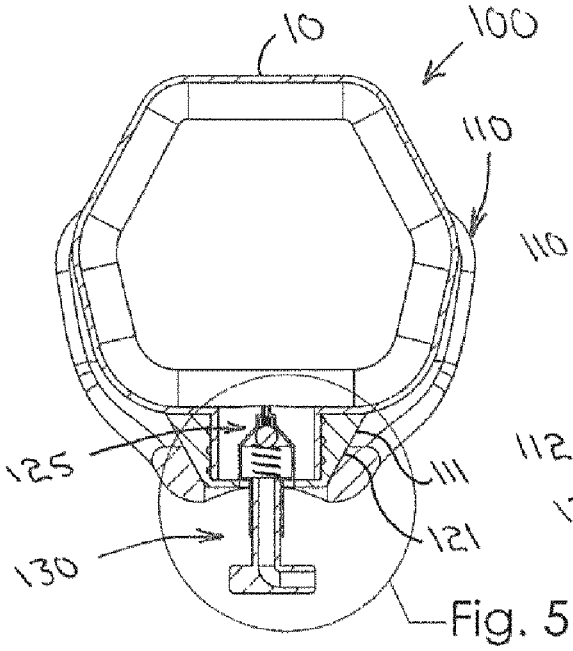
FIG. 3 is a sectional view taken from FIG. 2, showing a pump head at a pushed position.
Figure 2:
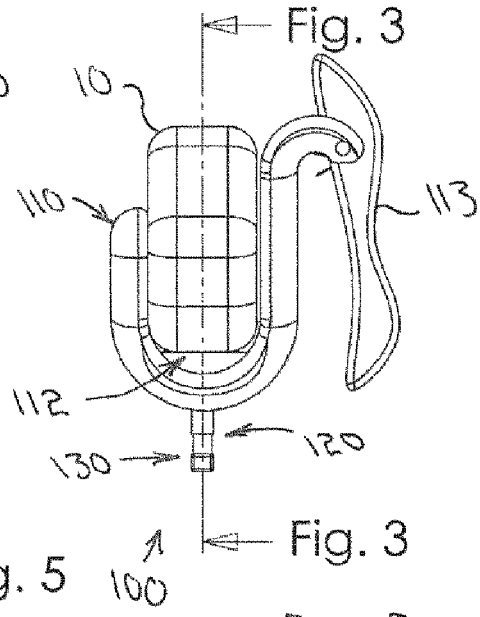
FIG. 2 is a side view showing the portable dispenser as in FIG. 1 coupled to a container.
Figure 4:
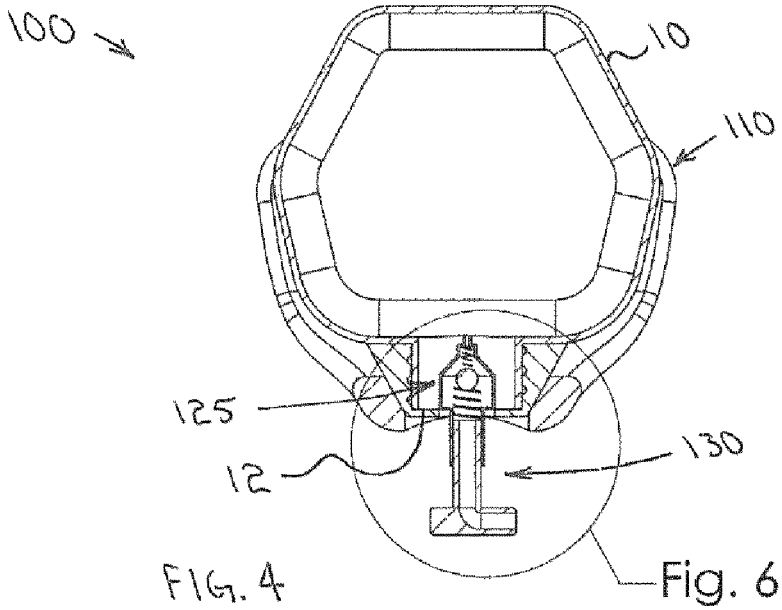
FIG. 4 is the sectional view as in FIG. 3, showing the pump head at a released position.

A portable dispenser according to the present invention will now be described in detail with reference to FIGS. 1 through 16 of the accompanying drawings. More particularly, a portable dispenser 100 for a viscous fluid (i.e., a disinfecting gel) housed in a container 10 having an opening 12 includes a housing 110 and an output device 120.

Figure 8:
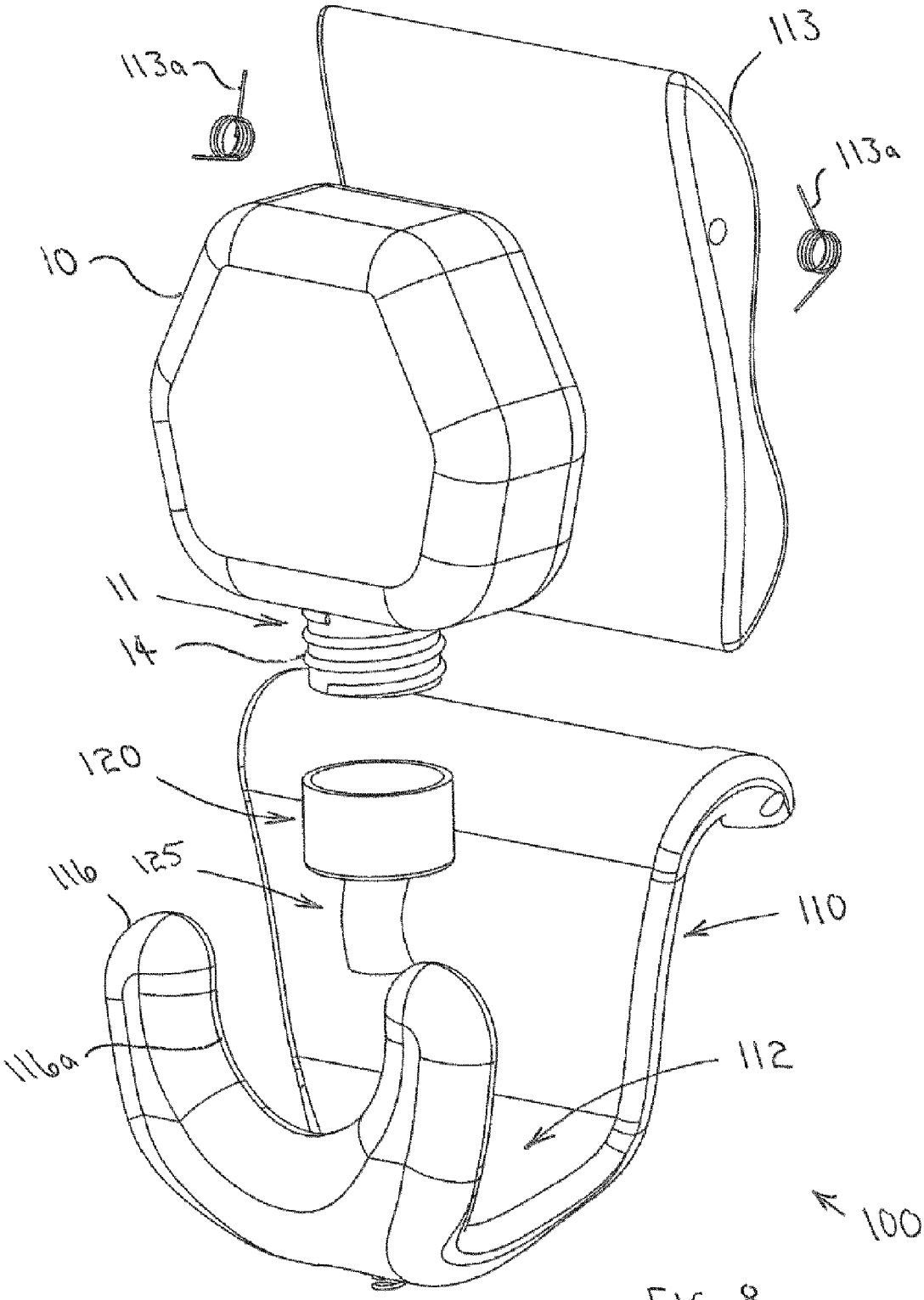
FIG. 8 is an exploded view showing the portable dispenser and container as in FIG. 7.
Figure 9:
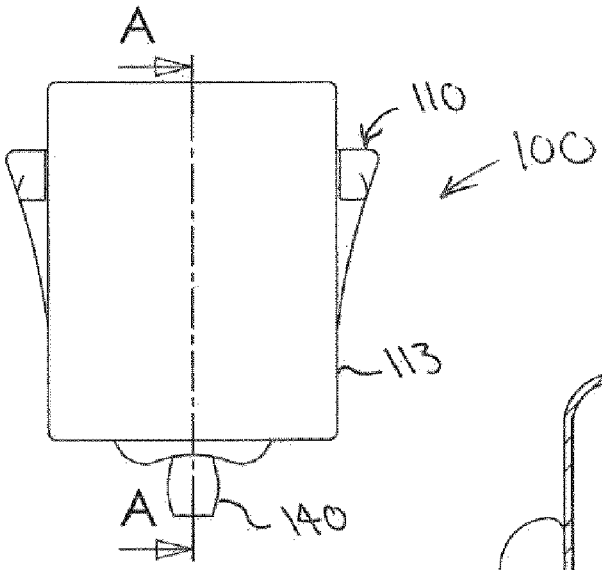
FIG. 9 is a rear view showing the portable dispenser and container as in FIG. 8.

As shown throughout the drawings, the housing 110 includes a receiving area 112 configured to accept the container 10, and a fastener 113 may be included for selectively attaching the housing 110 to an article of clothing (i.e., a belt or pocket). The fastener 113 may be integral with the housing 110 (FIGS. 12 through 16), or the fastener 113 may be coupled to the housing 110 (FIGS. 1 and 7 through 11) and biased by a spring 113*a* or another resilient member (FIG. 8).

The output device 120 is selectively combinable with the container 10 so that the viscous fluid may selectively pass from the container 10 through the container opening 12 and the output device 120 without first being transferred from the container 10 to the dispenser 100 for storage. As many containers 10 include threads 14 adjacent their respective container opening 12, the output device 120 may include threads 124 complementary to the container threads 14 for selectively attaching the container 10 and the output device 120. The threads 124 are best shown in FIGS. 3 through 6. The output device 120 may be combinable with the container 10 by utilizing other structure, as well. For example, another protrusion from or cavity in the output device 120 may mate with another protrusion from or cavity in the container 10 to selectively couple the output device 120 and the container 10.

Figure 5:
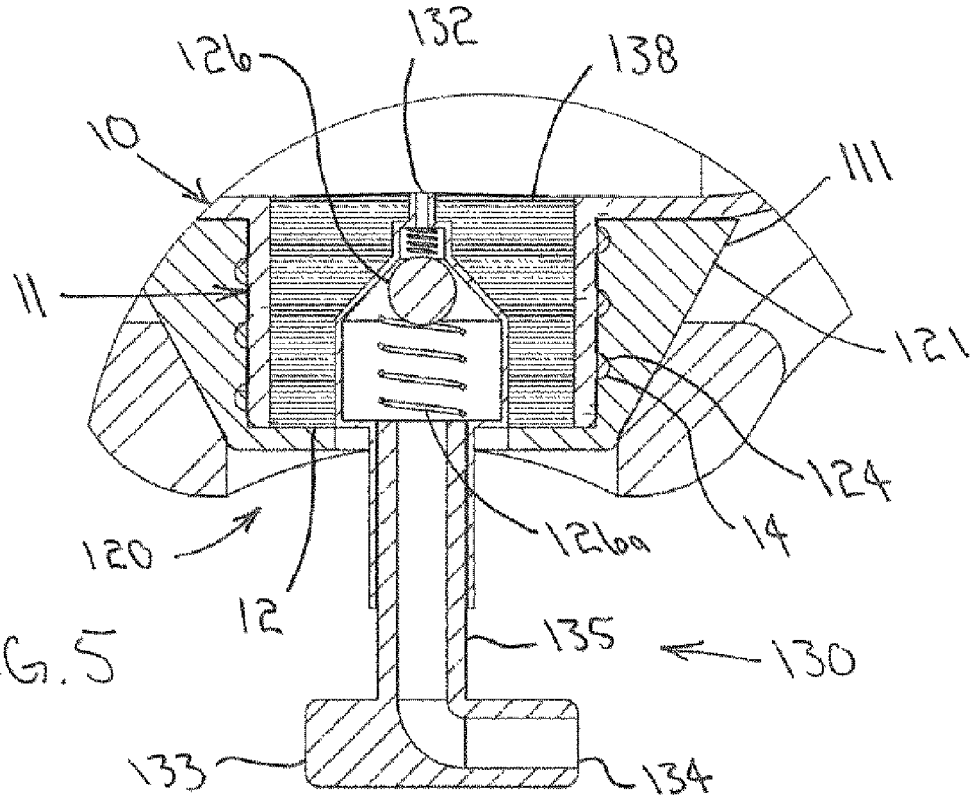
FIG. 5 is a sectional view taken from FIG. 3, according to an embodiment.
Figure 6:
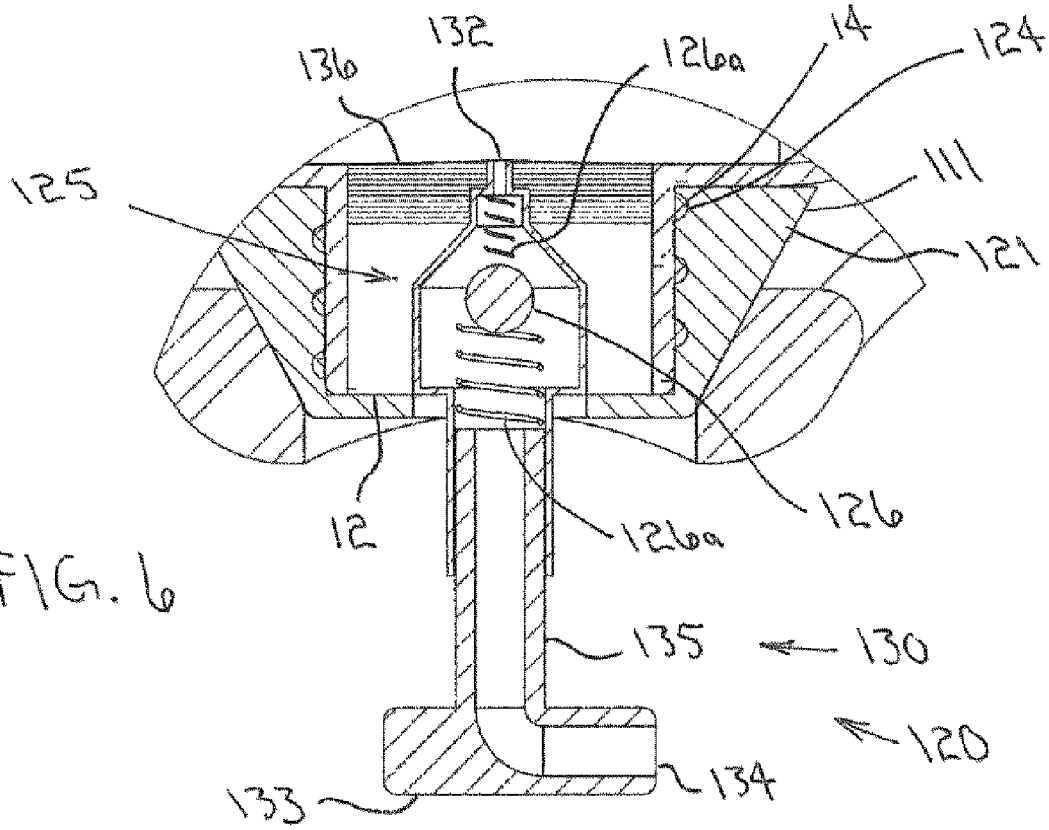
FIG. 6 is a sectional view taken from FIG. 4, according to an embodiment.
Figure 7:
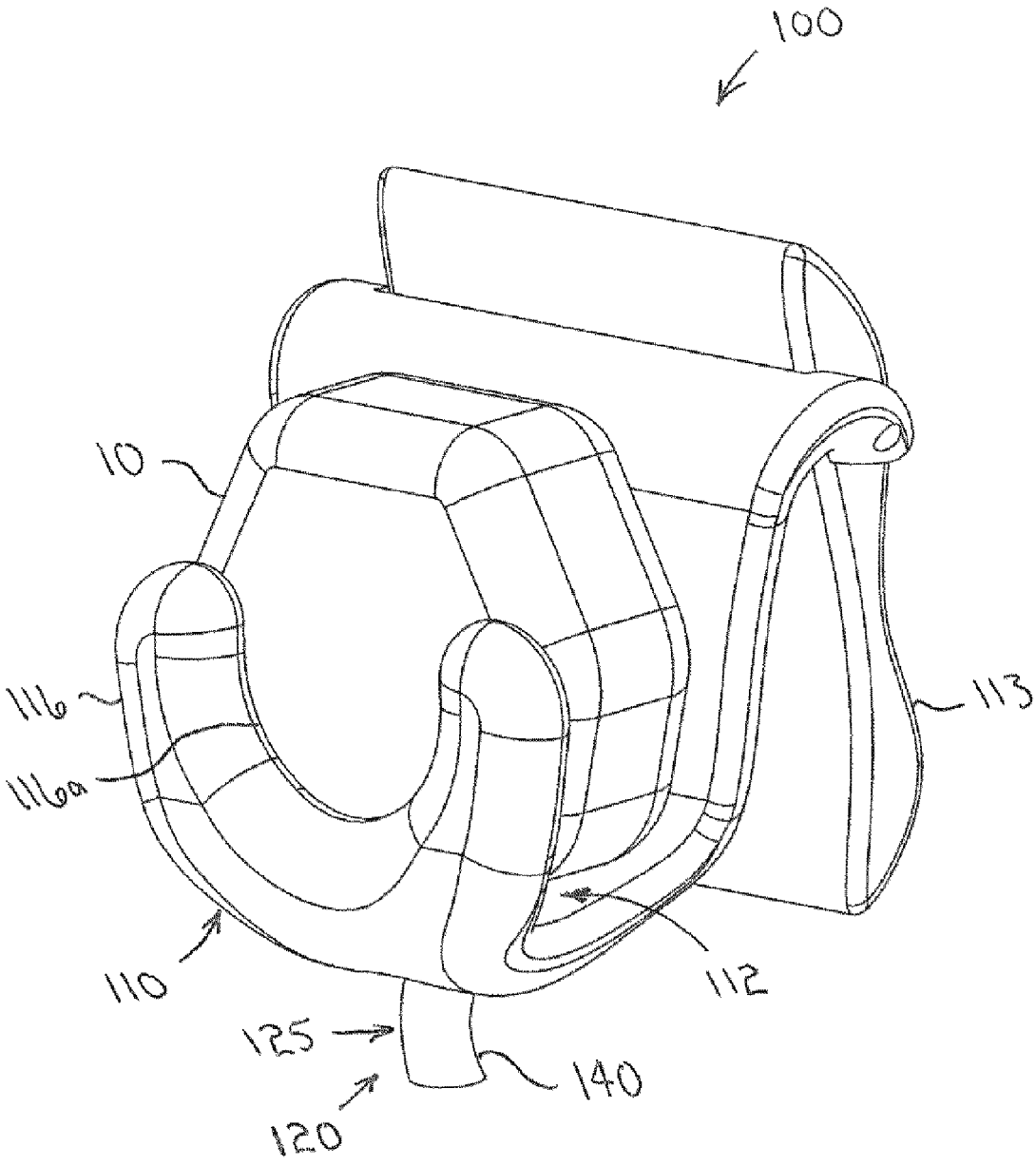
FIG. 7 is a perspective view showing a portable dispenser for a viscous fluid coupled to a container according to another embodiment.

As shown in FIGS. 3 through 6, the output device 120 may be selectively receivable in the housing 110. The output device 120 may be coupled to the housing 110 by friction or by a fastener, and the output device 120 and the housing 110 may present conical mating surfaces 121, 111 to aid in coupling the output device 120 and the housing 110 (FIGS. 5 and 6). Alternately, the output device 120 may be permanently fixed to the housing 110. The output device 120 may include a valve 125 for selectively allowing the viscous fluid to pass through the output device 120.

FIGS. 1 through 6 show that the output device 120 may include a pump 130 for selectively causing the viscous fluid to pass through the output device 120. The pump 130 may include an inlet 132 (FIGS. 5 and 6) and a head 133 having an outlet 134. The valve 125 may have a ball 126 and a spring 126*a* in communication with a pushrod 135 extending from the head 133, as shown in FIGS. 5 and 6. When the head 133 is pushed (FIGS. 3 and 5), the pushrod 135 may cause the ball 126 to seal the inlet 132, and fluid inside the pump 130 may be forced to exit the outlet 134. When the head 133 is released (FIGS. 4 and 6), the spring 126*a* may cause the ball 126 to move away from the inlet 132 and fluid to be pulled into the pump 130. Alternately, the pump 130 may utilize other pumping structure.

FIGS. 5 and 6 show that the pump 130 may seal a neck 11 of the container 10 adjacent the opening 12 and that the inlet 132 may be adjacent the neck 11. This allows all of the viscous fluid in the container 10 to enter the pump inlet 132 and exit the output device 120; otherwise, an amount of the fluid may become trapped in the neck 11 and unable to exit the pump 130. As shown in FIG. 5, a plug 138 may be coupled to or formed with the pump 130 to seal the container neck 11. As shown in FIG. 6, a seal 136 may extend outwardly from the inlet 132 to seal the container neck 11. The seal 136 and the plug 138 may be constructed of plastic, rubber, or another material.

Figure 11:
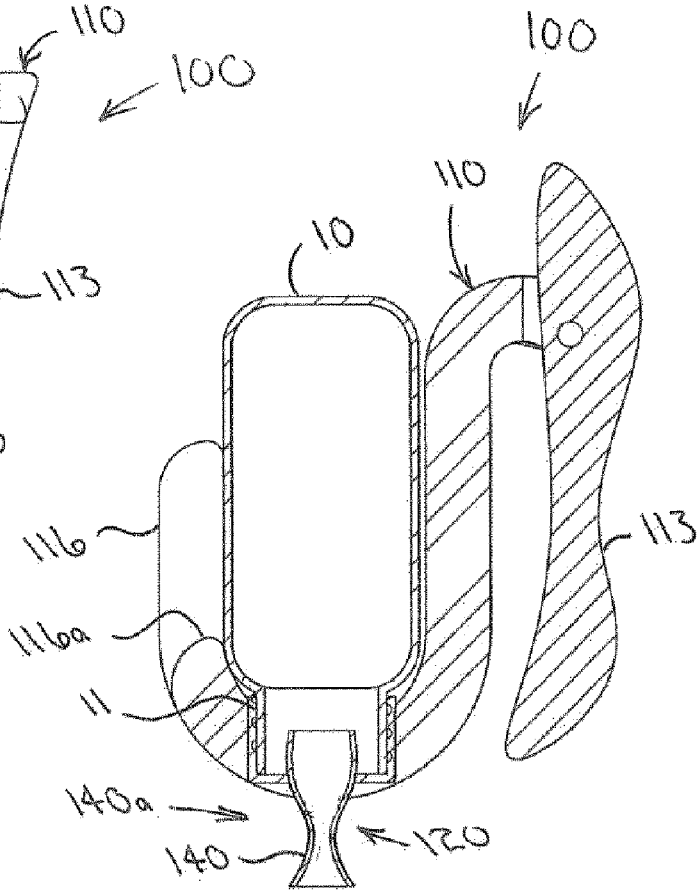
FIG. 11 is a sectional view showing the portable dispenser and container as in FIG. 10, with the outlet tube at a closed configuration.
Figure 10:
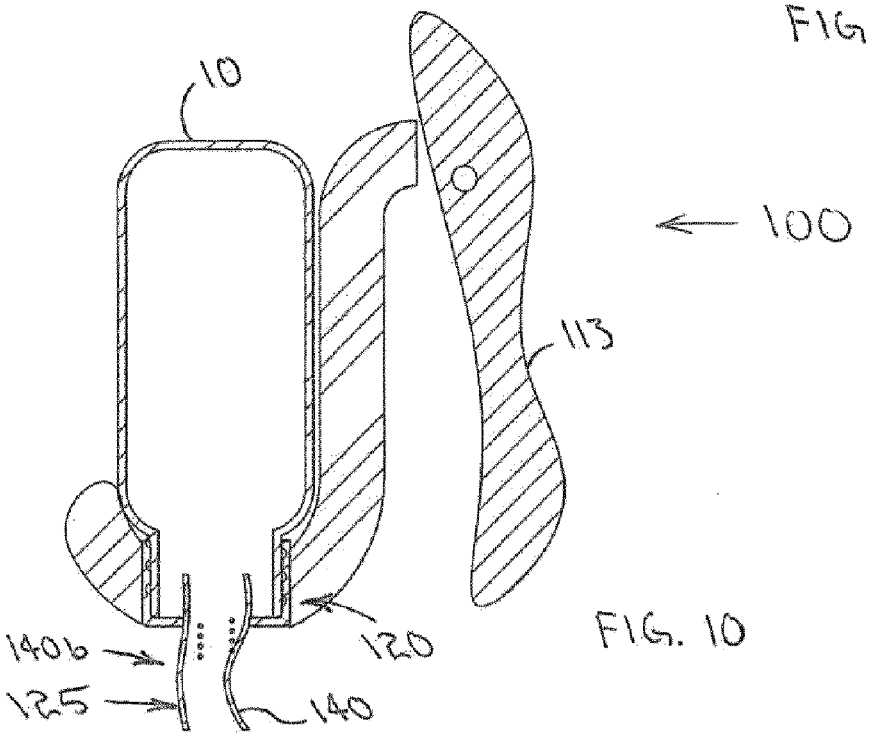
FIG. 10 is a sectional view taken along line A-A of FIG. 9, with an outlet tube at an open configuration.
Figure 12:
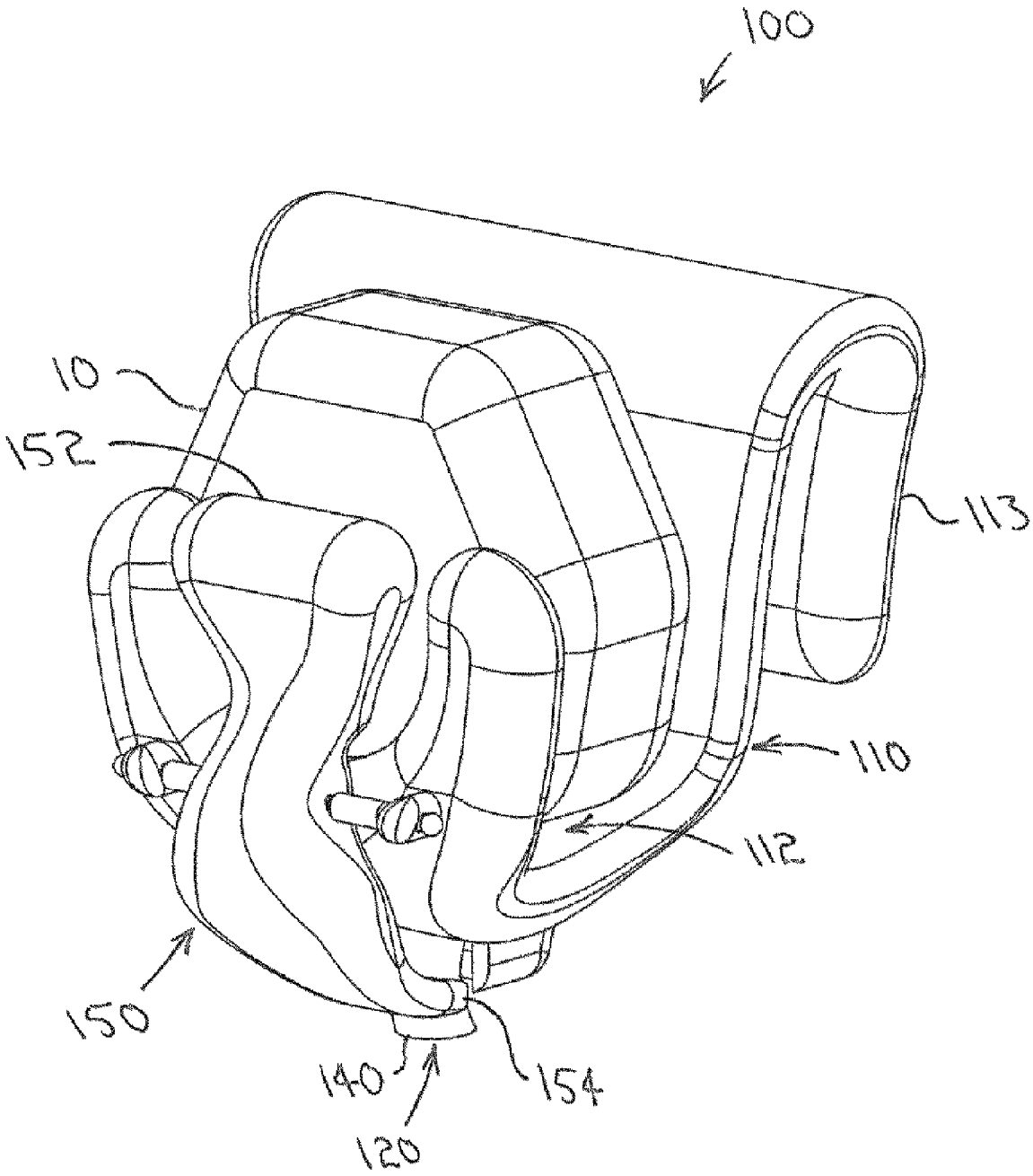
FIG. 12 is a perspective view showing a portable dispenser for a viscous fluid coupled to a container according to yet another embodiment.
Figure 13:
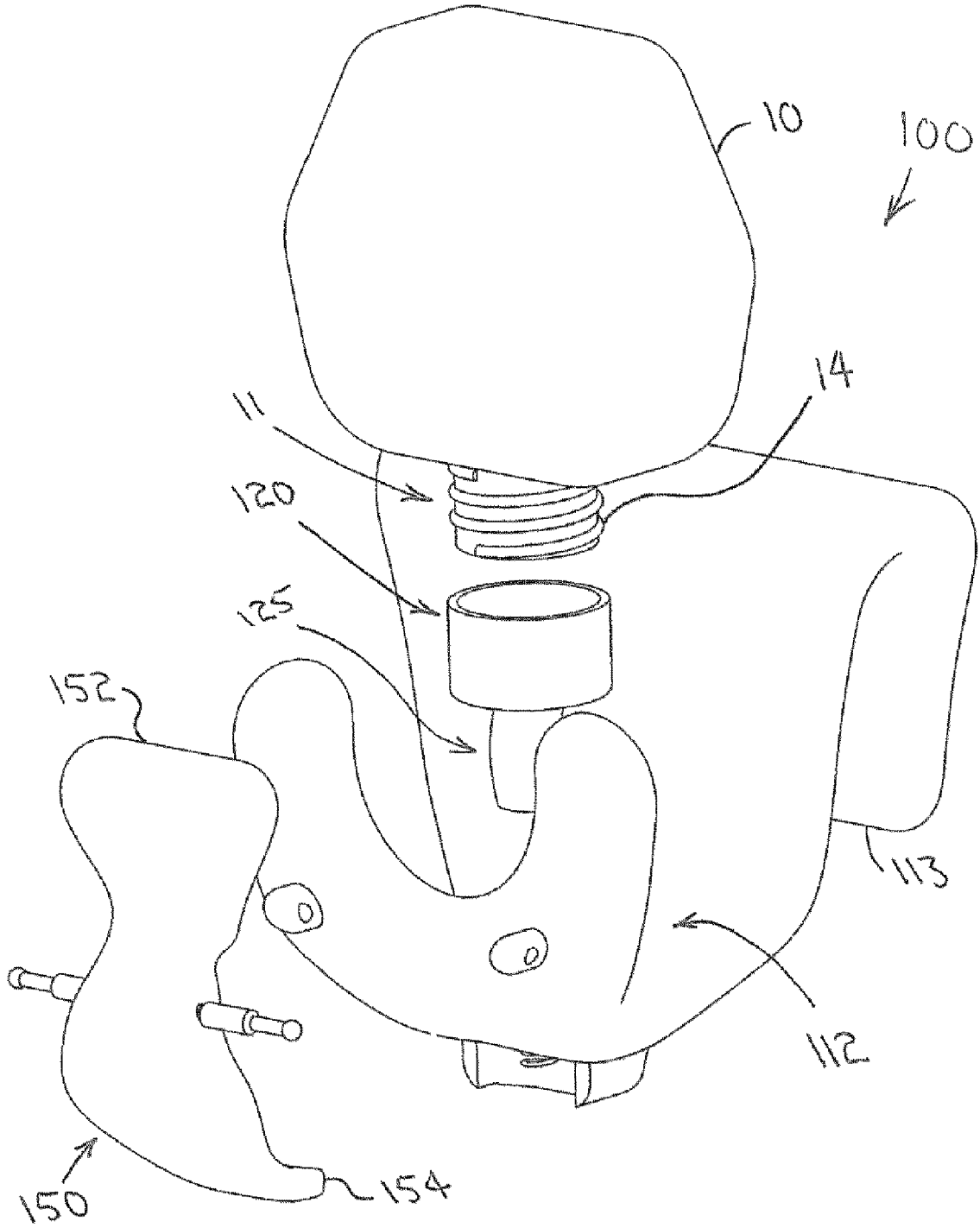
FIG. 13 is an exploded view showing the portable dispenser and container as in FIG. 12.
Figure 14:
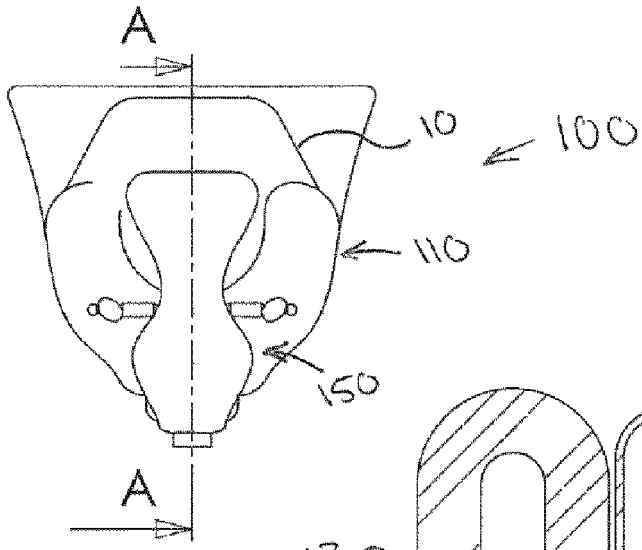
FIG. 14 is a front view showing the portable dispenser and container as in FIG. 12.

FIGS. 7 through 16 show that the valve 125 of the output device 120 may include an outlet tube 140 adjustable between a closed configuration 140*a* and an open configuration 140*b*. The outlet tube 140 is preferably biased toward the closed configuration 140*a* (FIG. 11) to keep the fluid inside the output device 120 and the container 10. By exerting pressure on the container 10, the viscous fluid may be forced through the outlet tube 140. Once the pressure is removed from the container 10, the outlet tube 140 may return from the open configuration 140*b* (FIG. 10) to the closed configuration 140*a* (FIG. 11). The housing 110 may include a front wall 116 to shield the container 10 from unwanted contact when the container 10 is attached to the output device 120 and the output device 120 is received in the housing 110, and the front wall 116 may define an opening 116*a* to allow access to the container 10 so that pressure may be selectively exerted on a wall of the container 10.

Figure 16:
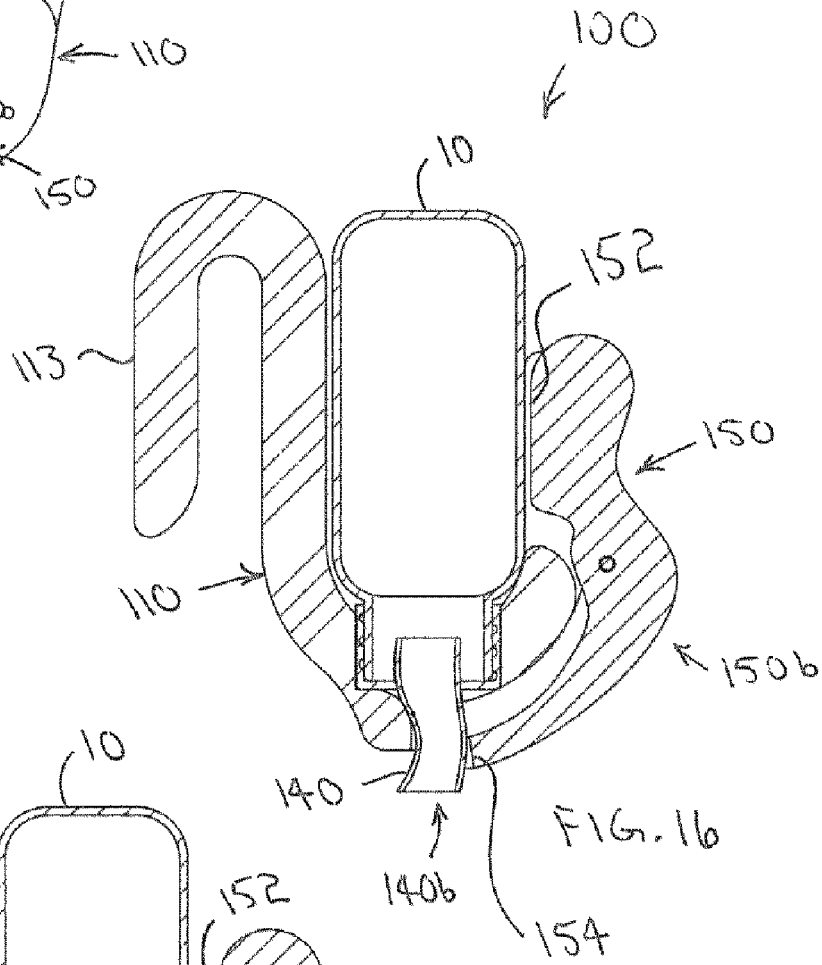
FIG. 16 is a sectional view showing the portable dispenser and container as in FIG. 15, with a rocker at a second configuration.
Figure 15:
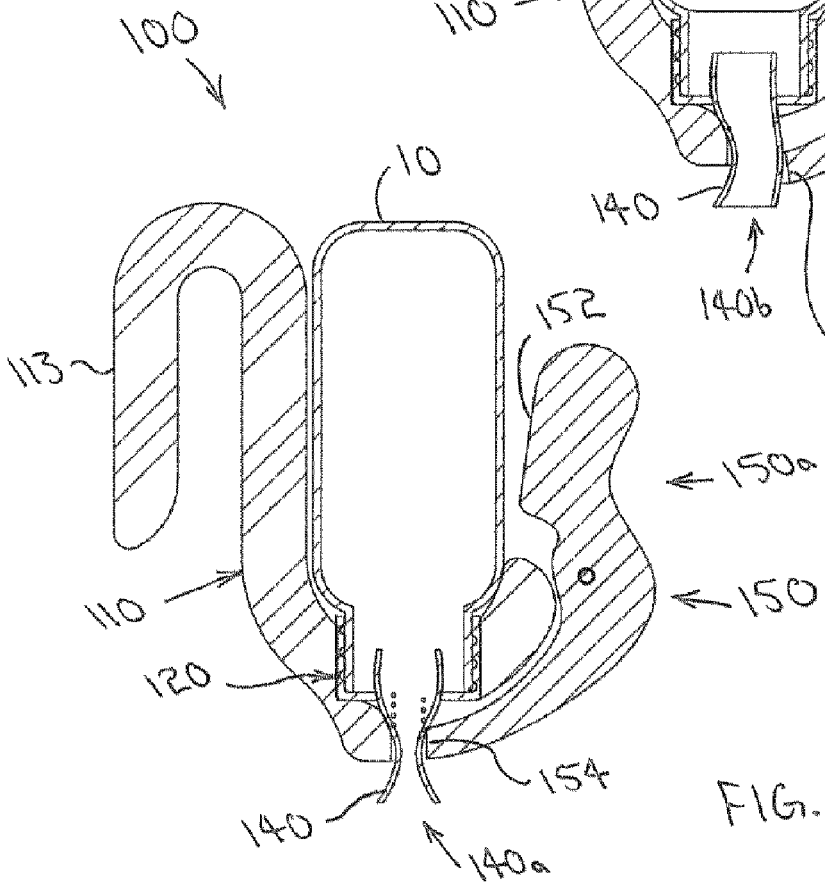
FIG. 15 is a sectional view taken along line A-A of FIG. 14, with a rocker at a first configuration.

FIGS. 12 through 16 show that a rocker 150 may be coupled to the housing 110 and movable between first and second configurations 150*a*, 150*b*. When at the first configuration 150*a*, a first end 152 of the rocker 150 does not exert a force on the container 10 and a second end 154 of the rocker 150 ensures the outlet tube 140 is at the closed configuration 140*a* (FIG. 15). When at the second configuration 150*b*, the rocker first end 152 exerts a force on the container 10 and the rocker second end 154 allows the outlet tube 140 to be at the open configuration 140*b* (FIG. 16). A spring (not shown) or another resilient member may bias the rocker 150 toward the first rocker configuration 150*a* so that the outlet tube 140 is normally at the closed configuration 140*a*. It should be understood that the phrase "does not exert a force on the container 10" herein means "does not exert an appreciable force on the container 10". In other words, the rocker 150 may contact the container 10 when at the first configuration 150*a* so long as the rocker 150 does not exert a force on the container 10 that forces the fluid out the outlet tube 140.

In an exemplary method of use, a container 10 housing a disinfecting gel may be coupled to the output device 120, such as by mating the container threads 14 and the output device threads 124. The output device 120 may then be joined to the housing 110 so that the container 10 is located in the housing receiving area 112 and the container opening 12 is below the disinfecting gel when the housing 110 is at a generally upright position (FIGS. 1 through 7, 9 through 12, and 14 through 16). The dispenser 100 may be attached to an article of clothing using the fastener 113, and an amount of the disinfecting gel may be selectively released from the container 10 through the output device 120.

One hand may cause the disinfecting gel to be released from the container 10, and the disinfecting gel may be released from the output device 120 to the one hand. For example, the one hand may press the pump head 133 to cause the gel to exit the outlet 134 if a pump 130 is included; the one hand may press on the container 10 to cause the gel to exit the outlet tube 140 if an outlet tube 140 is included; or the one hand may cause the rocker 150 to move from the first configuration 150*a* to the second configuration 150*b* if a rocker 150 is included. If the pump 130 is included, the user does not have to exert a force on a wall of the container 10. In other words, the user does not have to press on the container 10 if a pump 130 is included.

After all of the disinfecting gel is released through the output device 120, the container 10 and the output device 120 may be disassociated. A new container 10 having disinfecting gel may then be coupled to the output device 120 as described above, and the gel may be dispensed through the output device 120 as described above. The disassociated container 10 may be discarded, recycled, or refilled. Notably, the user does not have to transfer the gel from the container 10 to the dispenser 100 prior to dispensing the gel. The receiving area 112 is preferably sized to accommodate a two-ounce container 10 and/or an eight-ounce container 10, though the receiving area 112 may be sized to accommodate other containers 10.

It is understood that while certain forms of this invention have been illustrated and described, it is not limited thereto except insofar as such limitations are included in the following claims and allowable functional equivalents thereof.

What is claimed is as follows:

1. A portable dispenser for a viscous fluid, the viscous fluid being housed in a container having an opening, the dispenser comprising:

a housing having a receiving area configured to accept the container and having a fastener for selective attachment to an article of clothing; and an output device for selective coupling with the container, whereby the viscous fluid may selectively pass from the container through the container opening and the output device;

wherein the container includes threads adjacent the container opening;

wherein the output device includes threads complementary to the threads of the container for selective attachment of the container and the output device;

wherein the output device is selectively receivable in the housing and includes a valve for selectively allowing the viscous fluid to pass through the output device;

wherein the valve includes an outlet tube adjustable between a closed configuration and an open configuration;

wherein a rocker is coupled to the housing and movable between a first configuration in which a first end of the rocker does not exert a force on the container and a second end of the rocker ensures the outlet tube is at the closed configuration and a second configuration in which the rocker first end exerts a force on the container and the rocker second end allows the outlet tube to be at the open configuration;

wherein the rocker is biased toward the first rocker configuration;

wherein the housing has a front wall to shield the container from unwanted contact when the container is attached to the output device and the output device is received in the housing; and wherein the front wall is between the container and the rocker first end when the rocker is at the first configuration such that the container is closer to the front wall than to the rocker first end when the rocker is at the first configuration.

2. The dispenser of claim 1, wherein the front wall defines an opening to allow access to the container so that pressure may be exerted on a wall of the container, and wherein the rocker first end passes through the opening in the front wall when moving from the first configuration to the second configuration.

3. The dispenser of claim 1, wherein the force exerted by the rocker arm on the container aids in dispensing the fluid from the container.

4. The dispenser of claim 1, wherein the output device and the housing present complementary conical mating surfaces to aid in coupling the output device and the housing.

5. The dispenser of claim 4, wherein the force exerted by the rocker arm on the container aids in dispensing the fluid from the container.

6. A dispenser for a disinfecting gel, the disinfecting gel being housed in a container having an opening, the dispenser comprising:

a housing having a receiving area configured to receive the container;

a fastener attached to the housing for selectively attaching the housing to an article of clothing; and an output device for selective coupling with the container, whereby the gel may selectively pass from the container through the container opening and the output device without first being transferred from the container to the dispenser for storage;

wherein the output device includes a valve for selectively allowing the gel to pass through the output device;

wherein the valve includes an outlet tube adjustable between a closed configuration and an open configuration;

wherein a rocker is coupled to the housing and movable between a first configuration in which a first end of the rocker does not exert a force on the container and a second end of the rocker ensures the outlet tube is at the closed configuration and a second configuration in which the rocker first end exerts a force on the container and the rocker second end allows the outlet tube to be at the open configuration, the rocker not restraining any of the disinfecting gel from passing from the container through the container opening and the outlet tube when the rocker is at the second configuration;

wherein the rocker is biased toward the first rocker configuration;

wherein the housing has a front wall to shield the container from unwanted contact when the container is attached to the output device and the output device is received in the housing; and wherein the front wall is between the container and the rocker first end when the rocker is at the first configuration such that the container is closer to the front wall than to the rocker first end when the rocker is at the first configuration.

7. The dispenser of claim 6, wherein the output device is selectively receivable in the housing.

8. The dispenser of claim 3, wherein the fastener is integral with the housing.

9. The dispenser of claim 3, wherein the fastener is coupled to the housing and biased by a resilient member.

10. The dispenser of claim 6, wherein the force exerted by the rocker arm on the container aids in dispensing the gel from the container.

11. The dispenser of claim 6, wherein the output device and the housing present complementary conical mating surfaces to aid in coupling the output device and the housing.

12. The dispenser of claim 11, wherein the force exerted by the rocker arm on the container aids in dispensing the gel from the container.

13. A dispenser for a disinfecting gel, the disinfecting gel being housed in a container having an opening, the dispenser comprising:

a housing having a receiving area configured to receive the container;

a fastener attached to the housing for selectively attaching the housing to an article of clothing;

an output device removably coupled to the container such that the gel may pass from the container through the container opening and the output device without first being transferred from the container to the dispenser for storage, the output device being removably coupled to the housing; and a rocker coupled to the housing and movable between a first configuration in which a first end of the rocker does not exert a force on the container and a second end of the rocker ensures that the gel may not pass out the output device and a second configuration in which the rocker second end allows the gel to pass out the output device, the rocker not restraining any of the gel from passing from the container through the container opening and the output device when the rocker is at the second configuration, the rocker being biased toward the first configuration;

wherein the output device and the housing present complementary mating surfaces to aid in coupling the output device and the housing;

wherein at least one of:

(a) friction associated with the mating surfaces; and (b) a fastener removably couples the output device to the housing;

wherein the housing has a front wall to shield the container from unwanted contact when the container is attached to the output device and the output device is coupled to the housing; and wherein the front wall is between the container and the rocker first end when the rocker is at the first configuration such that the container is closer to the front wall than to the rocker first end when the rocker is at the first configuration.

14. The dispenser of claim 13, wherein the output device includes a pump for selectively causing the gel to pass through the output device.

15. The dispenser of claim 13, wherein the output device includes an outlet tube for selectively allowing the gel to pass through the output device, the outlet tube being adjustable between a closed configuration and an open configuration, the rocker second end maintaining the outlet tube at the closed configuration when the rocker is at the first configuration.

16. The dispenser of claim 13, wherein the complementary mating surfaces are complementary conical mating surfaces.

17. The dispenser of claim 13, wherein the output device is removed from the housing to couple the container to the output device and separate the container from the output device.

* * * * *